US012448882B2

(12) United States Patent
Behjat et al.

(10) Patent No.: US 12,448,882 B2
(45) Date of Patent: Oct. 21, 2025

(54) TOOL, SYSTEM AND METHOD FOR DELIVERING AND PRESSURE TESTING A DOWNHOLE PLUG IN ONE TRIP

(71) Applicant: Well-Set P&A AS, Stavanger (NO)

(72) Inventors: Nader Behjat, Stavanger (NO); Grant Mackenzie Knight, Voluntari (RO)

(73) Assignee: Well-Set P&A AS, Stavanger (NO)

( * ) Notice: Subject to any disclaimer, the term of this patent is extended or adjusted under 35 U.S.C. 154(b) by 0 days.

(21) Appl. No.: 18/727,959

(22) PCT Filed: Feb. 7, 2023

(86) PCT No.: PCT/NO2023/050029
§ 371 (c)(1),
(2) Date: Jul. 10, 2024

(87) PCT Pub. No.: WO2023/158317
PCT Pub. Date: Aug. 24, 2023

(65) Prior Publication Data

US 2025/0146406 A1 May 8, 2025

(30) Foreign Application Priority Data

Feb. 16, 2022 (NO) ..... 20220221

(51) Int. Cl.
*E21B 47/117* (2012.01)
*E21B 23/06* (2006.01)
*E21B 33/12* (2006.01)

(52) U.S. Cl.
CPC ..... *E21B 47/117* (2020.05); *E21B 23/06* (2013.01); *E21B 33/12* (2013.01)

(58) Field of Classification Search
CPC ..... E21B 47/117; E21B 23/06; E21B 33/12; E21B 29/00; E21B 33/13; E21B 47/06
See application file for complete search history.

(56) References Cited

U.S. PATENT DOCUMENTS 2,806,532 A * 9/1957 Baker ..... E21B 33/124 166/134
4,424,860 A * 1/1984 McGill ..... E21B 49/087 166/187

(Continued)

FOREIGN PATENT DOCUMENTS

GB 2555637 A 5/2018
WO 2018068154 A1 4/2018

OTHER PUBLICATIONS

Search Report for Corresponding Norwegian U.S. Appl. No. 20/220,221, dated Sep. 15, 2022.

(Continued)

*Primary Examiner* — Steven A MacDonald
(74) *Attorney, Agent, or Firm* — ANDRUS INTELLECTUAL PROPERTY LAW, LLP

(57) ABSTRACT

A plug delivery and pressure test tool are for delivering a plug to a wellbore or tubular and pressure testing the plug in a single trip. The tool has an uphole end and a downhole end; a sealing element; a pressure adjustment means; and a plug attachment means. The plug attachment means is configured to carry a selectively expandable plug to a desired location and selectively release the plug. The sealing element is configured to seal against an internal surface of the wellbore or tubular, thereby creating an isolated volume between the sealing element and the plug. The pressure adjustment means is configured to decrease the pressure in the isolated volume by moving fluid from the isolated volume to an upper fluid volume above the sealing element to create an underbalance in the isolated volume, thereby negatively pressure testing the plug in use.

20 Claims, 3 Drawing Sheets

(56) References Cited

U.S. PATENT DOCUMENTS 5,522,458 A * 6/1996 Watson ..... E21B 33/165 166/156
5,555,945 A * 9/1996 Schultz ..... E21B 33/1243 166/250.07
8,381,820 B2 * 2/2013 Martinez ..... E21B 43/128 166/105
11,255,154 B2 * 2/2022 Fagna ..... E21B 34/142
12,297,720 B2 * 5/2025 Al-Mousa ..... E21B 43/119
2002/0011333 A1 * 1/2002 Ward ..... E21B 43/26 166/250.15
2002/0017387 A1 * 2/2002 Ringgenberg ..... E21B 49/082 166/264
2003/0214879 A1 * 11/2003 Proett ..... E21B 49/008 340/853.2
2004/0040707 A1 * 3/2004 Dusterhoft ..... E21B 33/124 166/279
2008/0169105 A1 * 7/2008 Williamson ..... E21B 33/1294 166/374
2008/0234938 A1 * 9/2008 Niemeyer ..... E21B 49/008 702/11
2008/0314591 A1 * 12/2008 Hales ..... E21B 33/124 166/285
2009/0194277 A1 * 8/2009 Burnett ..... E21B 23/0414 166/55.1
2009/0204328 A1 * 8/2009 Stewart ..... G01V 9/00 702/12
2010/0058854 A1 * 3/2010 Waters ..... E21B 49/008 73/152.41
2015/0285024 A1 * 10/2015 Sanchez ..... E21B 33/134 166/250.01
2015/0361782 A1 12/2015 Halvor
2016/0090833 A1 * 3/2016 Samuelson ..... E21B 47/00 73/152.54
2017/0067313 A1 * 3/2017 Connell ..... E21B 34/06
2017/0081938 A1 * 3/2017 Richards ..... E21B 33/128
2018/0216432 A1 * 8/2018 Nelson ..... E21B 29/002
2018/0252069 A1 * 9/2018 Abdollah ..... E21B 33/13
2019/0128081 A1 * 5/2019 Ross ..... E21B 34/066
2019/0128095 A1 * 5/2019 Hess ..... E21B 43/045
2019/0203567 A1 * 7/2019 Ross ..... E21B 49/008
2019/0284898 A1 9/2019 Fagna
2019/0323307 A1 * 10/2019 George ..... E21B 47/12
2020/0056446 A1 * 2/2020 Al-Mousa ..... E21B 33/1293
2020/0088001 A1 * 3/2020 Morland ..... E21B 23/04
2020/0182048 A1 6/2020 Stein
2021/0123321 A1 * 4/2021 Assal ..... E21B 23/01
2024/0337168 A1 * 10/2024 Al-Ghannam ..... E21B 34/063
2025/0027411 A1 * 1/2025 Dubost ..... E21B 49/10

OTHER PUBLICATIONS

International Search Report and the Written Opinion for Corresponding Application No. PCT/No. 2023/050029, dated Apr. 6, 2023.

Response to the Written Opinion for for Corresponding Application No. PCT/No. 2023/050029, dated Jun. 13, 2023.

* cited by examiner

TOOL, SYSTEM AND METHOD FOR DELIVERING AND PRESSURE TESTING A DOWNHOLE PLUG IN ONE TRIP

CROSS-REFERENCE TO RELATED APPLICATIONS

This application is the U.S. national stage application of International Application No. PCT/NO2023/050029, filed Feb. 7, 2023, which international application was published on Aug. 24, 2023, as WO 2023/158317 in the English language. The International Application claims priority to Norwegian patent application No. 20220221, filed Feb. 16, 2022. The international application and Norwegian application are both incorporated herein by reference, in their entirety.

FIELD

The present invention relates to a system and method for plugging a well extending into a hydrocarbon bearing formation with a plug and pressure testing the plug after it has been set.

BACKGROUND

Oil and gas wells can generally either be production wells where hydrocarbons are produced and brought to the surface; injection wells where water, or other liquids or gas is injected into the well to boost reservoir pressure or for depositing fluids in the well; or exploration wells where hydrocarbon bearing formations are explored.

In all three types of wells, it is commonly required to set plugs inside the well tubulars to act as well barriers. A well barrier in intended to prevent the flow of hydrocarbons and contributes to well integrity and safety. Plugs that are set to act as well barriers may be installed permanently or temporarily for a certain period of time.

An oil and gas well is constructed by drilling a long, relatively narrow, hole into a hydrocarbon bearing reservoir, using a drill bit attached to the end of drill pipe extending sometimes thousands of kilometres deep into the ground. Once the wellbore has been drilled, sections of tubular steel, casing or liner are inserted into the wellbore to strengthen the wellbore and prevent collapsing of the wellbore. Cement is injected between the outside of these tubulars and the wellbore and tubing is run to connect the wellbore to the surface, thereby allowing a path for the hydrocarbons to be extracted from the hydrocarbon bearing formation. For ease of reference, all of the above-mentioned tubulars, including the sections of tubular steel, casing sections, liner sections and tubing sections, are herein referred to as "tubulars".

When a plug is set inside a tubular to act as a well barrier, once the plug has been set it is necessary to verify that the plug forms a sufficiently pressure-tight seal across the tubular. If the plug is not set properly such that it can withstand positive or negative pressures across it, the plug may become a serious liability with grave consequences if the plug fails in use.

Currently, plugs are typically run into the well on wireline and set at their desired depth. A pressure testing tool may then be run into the well to perform a pressure test on the plug to ensure the integrity of the plug.

The journey taken by equipment from the surface to the point at which the equipment is used in the well is known as a trip. The time taken to perform a trip, either into or out of the wellbore, is extremely expensive, and there is a constant strive to making tripping of equipment faster or more efficient, which would greatly reduce cost. Many efforts have been made in the prior art to trip more efficiently, or to make fewer trips to reduce costs.

The invention has for its object to remedy or to reduce at least one of the drawbacks of the prior art, or at least provide a useful alternative to prior art.

The object is achieved through features, which are specified in the description below and in the claims that follow.

Patent document WO2018/068154A1 discloses a well abandonment tool comprising an elongate housing extending between top and bottom ends locatable within a wellbore having a longitudinal pumping cylindrical bore therein. The apparatus further comprises a wellbore seal located around the housing operable to engage upon the wellbore and to be expanded into contact therewith upon an upward motion of the housing so as to seal an annulus between the housing and the wellbore and a bridge plug engagement connector adapter to secure a bridge plug thereto at a position below the bottom end of the housing.

Patent document US2019/0284898A1 discloses a method of setting tandem releasable bridge plug system in a casing including assembling a tandem bridge plug string including a lower bridge plug and an upper bridge plug.

Patent document GB2555637A discloses methods and device for plug placement and verification in a well. This includes placing the tool at the formation to be plugged, inflating an expandable packer beneath the formation and then delivering plugging material, i.e. cement, above the packer to form the plug. There is a pressure sensor mounted under the packer, there may also be a temperature sensor above the packer.

SUMMARY

The invention is defined by the independent patent claims. The dependent claims define advantageous embodiments of the invention.

According to a first aspect of the invention, there is provided a plug delivery and pressure test tool for delivering a plug to a wellbore or tubular and pressure testing the plug in a single trip, the tool comprising: an uphole end and a downhole end; a sealing element; a pressure adjustment means; and a plug attachment means located at or near the downhole end; wherein the plug attachment means is configured to carry a selectively expandable plug to a desired location in the wellbore or tubular and selectively release the plug from at or near the downhole end of the tool; the sealing element is configured to seal against an internal surface of the wellbore or tubular in use, thereby creating an isolated volume in use, between the sealing element and the plug; and the pressure adjustment means is configured to decrease the pressure in the isolated volume by moving fluid from the isolated volume to an upper fluid volume above the sealing element to create an underbalance in the isolated volume, thereby negatively pressure testing the plug in use.

The pressure adjustment means may be configured in use to adjust the pressure in the isolated volume by moving fluid from the upper fluid volume above the sealing element to the isolated volume to create an overbalance in the isolated volume, thereby positively pressure testing the plug.

The pressure adjustment means may be a pump or a piston or a pressure adjustment chamber.

The sealing element may be an expandable or conformable packer.

The sealing element may be expandable from a collapsed configuration to an expanded configuration, wherein in the collapsed configuration the sealing element is configured to be run into a wellbore or tubular without forming a seal with the internal surface of the wellbore or tubular, and in the expanded configuration the sealing element is configured to form a seal with the internal surface of the wellbore or tubular.

The tool may further comprise: a fluid inlet port; and a fluid outlet port; wherein the fluid inlet port is located between the sealing element and the plug attachment means, and is in fluid communication with the pressure adjustment means, and the fluid outlet port is located between the sealing element and the uphole end of the tool, and is in fluid communication with the pressure adjustment means.

Alternatively, the tool may further comprise: a fluid inlet port; and a fluid outlet port; wherein the fluid outlet port is located between the sealing element and the plug attachment means, and is in fluid communication with the pressure adjustment means, and the fluid inlet port is located between the sealing element and the uphole end of the tool, and is in fluid communication with the pressure adjustment means.

Alternatively, the tool may further comprise: a first fluid inlet and outlet port; and a second fluid inlet and outlet port; wherein the first fluid inlet and outlet port is located between the sealing element and the plug attachment means, and is in fluid communication with the pressure adjustment means, and the second fluid inlet and outlet port is located between the sealing element and the uphole end of the tool, and is in fluid communication with the pressure adjustment means.

The tool may further comprise: an upper pressure sensor configured to measure a pressure in the wellbore or tubular between the sealing element and the uphole end of the tool or at the uphole end of the tool in use, and/or; an intermediate pressure sensor configured to measure a pressure in the isolated volume in use.

The plug attachment means may comprise a shear pin and/or electromechanical latch and/or hydraulic locking mechanism.

The plug attachment means may be configured in use to selectively reattach the plug at or near the downhole end of the tool and carry the plug to a desired location in the wellbore or tubular.

The tool may further comprise a tubing cutter configured to selectively cut a tubular.

The tool may further comprise a tubing puncher configured to selectively form at least one aperture in a tubular.

According to a second aspect of the invention, there is provided a system for delivering and pressure testing a plug in a wellbore or tubular in a single trip, the system comprising: a tool according to the first aspect of the invention; a selectively expandable plug; wherein the plug is configured to be releasably attached to the plug attachment means in use.

The plug may be configured to seal against an internal surface of the wellbore or tubular in use, thereby creating a pressure tight seal.

The plug may be an expandable or conformable packer.

The plug may be expandable from a collapsed configuration to an expanded configuration, wherein in the collapsed configuration the plug is configured to be run into a wellbore or tubular without forming a seal with the internal surface of the wellbore or tubular, and in the expanded configuration the plug is configured to form a seal with the internal surface of the wellbore or tubular.

The plug may be configured to be reattachable to the tool in use after the plug has been released from the tool.

The plug may comprises a lower pressure sensor configured to measure a pressure in the wellbore or tubular below the plug in use.

The system may further comprise a tubing cutter configured to selectively cut a tubular.

The system may further comprise a tubing puncher configured to selectively form at least one aperture in a tubular.

According to a third aspect of the invention, there is provided a method of assembling a system for delivering a plug to a wellbore and performing a pressure test on the plug in a single trip, comprising the steps of: providing a tool according to the first aspect of the invention; providing a selectively expandable plug configured to be releasably attached to the plug attachment means of the tool; and releasably attaching the plug to the plug attachment means.

According to a fourth aspect of the invention, there is provided a method of setting and pressure testing a plug in a single trip, comprising the steps of: providing a system according to the second aspect of the invention; releasably attaching the plug to the plug attachment means; running the system into a wellbore or tubular to a desired location in the wellbore or tubular; moving the plug to the expanded configuration to form a pressure tight seal in the wellbore or tubular; releasing the plug from the plug attachment means; lifting the tool uphole in the wellbore or tubular; moving the sealing element to the expanded configuration to form a pressure tight seal in the wellbore or tubular, thereby creating an isolated volume; and activating the pressure adjustment means to decrease the pressure in the isolated volume, thereby pressure testing the plug.

According to a fifth aspect of the invention, there is provided a method of pressure testing and setting a plug in a single trip, comprising the steps of: providing a system according to the second aspect of the invention; releasably attaching the plug to the plug attachment means; running the system into a wellbore or tubular to a desired location in the wellbore or tubular; moving the plug to the expanded configuration to form a pressure tight seal in the wellbore or tubular; moving the sealing element to the expanded configuration to form a pressure tight seal in the wellbore or tubular, thereby creating an isolated volume; activating the pressure adjustment means to decrease the pressure in the isolated volume, thereby pressure testing the plug; and releasing the plug from the plug attachment means.

According to the sixth aspect of the invention, there is provided a method of pressure testing and setting a plug in a single trip, comprising the steps of: providing a system according to the second aspect of the invention; releasably attaching the plug to the plug attachment means; running the system into a wellbore or tubular to a desired location in the wellbore or tubular; moving the sealing element to the expanded configuration to form a pressure tight seal in the wellbore or tubular; moving the plug to the expanded configuration to form a pressure tight seal in the wellbore or tubular thereby creating an isolated volume; activating the pressure adjustment means to decrease the pressure in the isolated volume, thereby pressure testing the plug; and releasing the plug from the plug attachment means.

According to a first clause, there is provided a plug delivery and pressure test tool for delivering a plug to a wellbore or tubular and pressure testing the plug in a single trip, the tool comprising: an uphole end and a downhole end; a sealing element; a pressure adjustment means; and a plug attachment means located at or near the downhole end; wherein the plug attachment means is configured to carry a selectively expandable plug to a desired location in the wellbore or tubular and selectively release the plug from at or near the downhole end of the tool; the sealing element is configured to seal against an internal surface of the wellbore or tubular in use, thereby creating an isolated volume in use, between the sealing element and the plug; and the pressure adjustment means is configured to increase or decrease the pressure in the isolated volume, in use, thereby creating a pressure differential across the plug to perform a pressure test of the plug.

The pressure adjustment means may be configured in use to adjust the pressure in the isolated volume by either: moving fluid from the isolated volume to an upper fluid volume above the sealing element to create an underbalance in the isolated volume, thereby negatively pressure testing the plug or moving fluid from an upper fluid volume above the sealing element to the isolated volume to create an overbalance in the isolated volume, thereby positively pressure testing the plug.

The pressure adjustment means may be a pump or a piston or a pressure adjustment chamber.

The sealing element may be an expandable or conformable packer.

The sealing element may be expandable from a collapsed configuration to an expanded configuration, wherein in the collapsed configuration the sealing element is configured to be run into a wellbore or tubular without forming a seal with the internal surface of the wellbore or tubular, and in the expanded configuration the sealing element is configured to form a seal with the internal surface of the wellbore or tubular.

The tool may further comprise: a fluid inlet port; and a fluid outlet port; wherein the fluid inlet port is located between the sealing element and the plug attachment means, and is in fluid communication with the pressure adjustment means, and the fluid outlet port is located between the sealing element and the uphole end of the tool, and is in fluid communication with the pressure adjustment means.

The tool may further comprise: a fluid inlet port; and a fluid outlet port; wherein the fluid outlet port is located between the sealing element and the plug attachment means, and is in fluid communication with the pressure adjustment means, and the fluid inlet port is located between the sealing element and the uphole end of the tool, and is in fluid communication with the pressure adjustment means.

The tool may further comprise: a first fluid inlet and outlet port; and a second fluid inlet and outlet port; wherein the first fluid inlet and outlet port is located between the sealing element and the plug attachment means, and is in fluid communication with the pressure adjustment means, and the second fluid inlet and outlet port is located between the sealing element and the uphole end of the tool, and is in fluid communication with the pressure adjustment means.

The tool may further comprise: an upper pressure sensor configured to measure a pressure in the wellbore or tubular between the sealing element and the uphole end of the tool or at the uphole end of the tool in use, and/or; an intermediate pressure sensor configured to measure a pressure in the isolated volume in use.

The plug attachment means may comprise a shear pin and/or electromechanical latch and/or hydraulic locking mechanism.

The plug attachment means may be configured in use to selectively reattach the plug at or near the downhole end of the tool and carry the plug to a desired location in the wellbore or tubular.

According to a twelfth clause, there is provided a system for delivering and pressure testing a plug in a wellbore or tubular in a single trip, the system comprising: a tool according to the first clause; a selectively expandable plug; wherein the plug is configured to be releasably attached to the plug attachment means in use.

The plug may be configured to seal against an internal surface of the wellbore or tubular in use, thereby creating a pressure tight seal.

The plug may be an expandable or conformable packer.

The plug may be expandable from a collapsed configuration to an expanded configuration, wherein in the collapsed configuration the plug is configured to be run into a wellbore or tubular without forming a seal with the internal surface of the wellbore or tubular, and in the expanded configuration the plug is configured to form a seal with the internal surface of the wellbore or tubular.

The plug may be configured to be reattachable to the tool in use after the plug has been released from the tool.

The plug may comprise a lower pressure sensor configured to measure a pressure in the wellbore or tubular below the plug in use.

According to a eighteenth clause, there is provided a method of assembling a system for delivering a plug to a wellbore and performing a pressure test on the plug in a single trip, comprising the steps of: providing a tool according to the first clause; providing a selectively expandable plug configured to be releasably attached to the plug attachment means of the tool; and releasably attaching the plug to the plug attachment means.

According to a nineteenth clause, there is provided a method of setting and pressure testing a plug in a single trip, comprising the steps of: providing a system according to the twelfth clause; releasably attaching the plug to the plug attachment means; running the system into a wellbore or tubular to a desired location in the wellbore or tubular; moving the plug to the expanded configuration to form a pressure tight seal in the wellbore or tubular; releasing the plug from the plug attachment means; lifting the tool uphole in the wellbore or tubular; moving the sealing element to the expanded configuration to form a pressure tight seal in the wellbore or tubular, thereby creating an isolated volume; and activating the pressure adjustment means to increase or decrease the pressure in the isolated volume, thereby pressure testing the plug.

According to a twentieth clause, there is provided a method of pressure testing and setting a plug in a single trip, comprising the steps of: providing a system according to the twelfth clause; releasably attaching the plug to the plug attachment means; running the system into a wellbore or tubular to a desired location in the wellbore or tubular; moving the plug to the expanded configuration to form a pressure tight seal in the wellbore or tubular; moving the sealing element to the expanded configuration to form a pressure tight seal in the wellbore or tubular, thereby creating an isolated volume; activating the pressure adjustment means to increase or decrease the pressure in the isolated volume, thereby pressure testing the plug; and releasing the plug from the plug attachment means.

According to a twenty first clause, there is provided a method of pressure testing and setting a plug in a single trip, comprising the steps of: providing a system according to the twelfth clause; releasably attaching the plug to the plug attachment means; running the system into a wellbore or tubular to a desired location in the wellbore or tubular; moving the sealing element to the expanded configuration to form a pressure tight seal in the wellbore or tubular; moving the plug to the expanded configuration to form a pressure tight seal in the wellbore or tubular, thereby creating an isolated volume; activating the pressure adjustment means to increase or decrease the pressure in the isolated volume, thereby pressure testing the plug; and releasing the plug from the plug attachment means.

BRIEF DESCRIPTION OF THE DRAWINGS

Embodiments of the invention will now be described with reference to the following drawings, in which.

Figure 1:
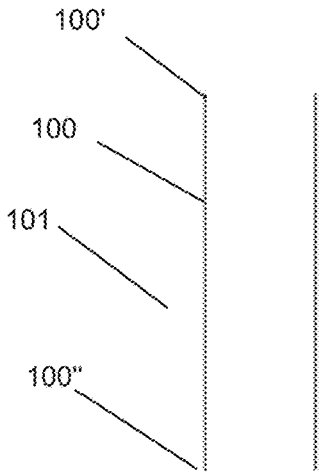
FIG. 1 shows a schematic of a standard wellbore.

For clarity reasons, some elements may in some of the figures be without reference numerals. A person skilled in the art will understand that the figures are just principal drawings. The relative proportions of individual elements may also be distorted.

DETAILED DESCRIPTION OF THE DRAWINGS

In the following is described examples of preferred embodiments illustrated in the accompanying drawings.

FIG. 1 shows a simplified schematic of a known wellbore construction configuration comprising a wellbore 100 configured within formation 101. The wellbore 100 extends from an uphole end 100' to a downhole end 100". It will be understood that in the presently described example a wellbore 100 is provided where the plug is to be set (as will be described later). However, in other examples the plug (not shown in FIG. 1) may be set in another tubular used in the construction of the wellbore, for example in a liner, a tubing or a casing. Alternatively, the plug may be set in a liner, a tubing or a casing which has had a section milled or extracted such that the plug may extend through the milled or extracted portion to reach the wellbore 100 therebehind.

It will be understood by those skilled in the art that a myriad of equipment may be used in wellbore 100 which is omitted here in the interest of clarity.

Figure 2:
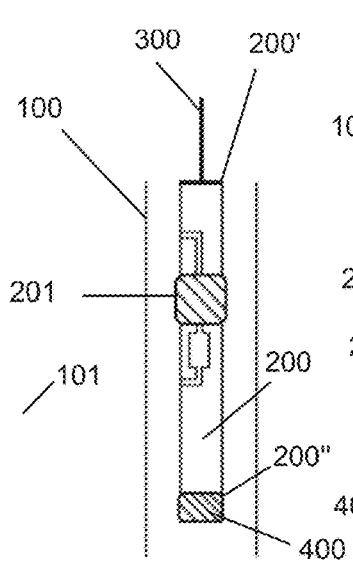
FIG. 2 shows the plug delivery and pressure test tool with the plug being run in hole.

Referring now to FIG. 2, a tool 200 has been run into the wellbore 100. The tool 200 has been lowered into the wellbore 100 on an electric wireline 300 which provides power and communications between the tool 200 and the surface such that operators of the tool 200 at the surface can control the tool 200, as is well known in the art.

The tool 200 comprises a sealing element 201 which is configured to be operatively engageable with the internal surface of the wellbore 100 when in use in the wellbore 100. The sealing element 201 is an expandable packer in the presently described example. In other examples (not shown) the sealing element 201 may be a conformable packer. It will be understood that the sealing element 201 may be any component configured to be movable from a collapsed configuration, which allows the tool 200 to be run into the wellbore 100 without forming a seal with the wellbore 100 (or cement or casing attached to the internal surface of the wellbore 100, or other tubulars as previously described) and then moved to an expanded configuration, as will be explained with reference to later Figures.

Still referring to FIG. 2, the tool 200 has an uphole end 200' and a downhole end 200". The electric wireline 300 is attached at the uphole end 200' of the tool 200 such that the tool 200 can be lowered and lifted inside the wellbore 100, and such that a force in the uphole direction can be applied to the tool 200 when required, as will be explained later.

Figure 3:
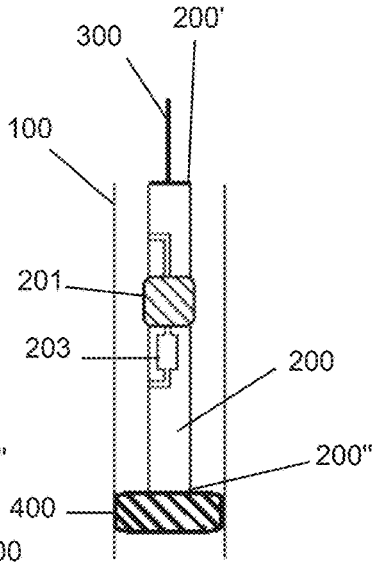
FIG. 3 shows the tool of FIG. 2 with the plug in the expanded configuration.

At the downhole end 200" there is releasably attached a selectively expandable plug 400. The plug 400 is attached to the tool 200 such that the plug 400 can be lowered into the wellbore 100 to a desired position where the plug 400 should be set, i.e. expanded, to provide a seal across the wellbore 100, as is shown in FIG. 3. The plug 400 in the presently described example is an expandable packer. However, in other examples (not shown) the plug 400 may be a conformable packer. It will be understood that the plug 400 may be any component configured to be movable from a collapsed configuration, which allows the plug 400 to be run into the wellbore 100 without forming a seal with the wellbore 100 (or cement or casing attached to the internal surface of the wellbore 100, or any other tubulars or equipment as previously described) and then moved to an expanded configuration shown in FIG. 3 to form a pressure tight seal against the wellbore 100. In this connection, the plug 400 may be operated in some examples by electrical connection (not shown) between the tool 200 and the plug 400 to move the plug 400 to the expanded configuration.

In other examples (not shown) hydraulic pressure may be provided by a pump 203 in the tool 200 with a connection (not shown) between the pump 203 and the plug 400 configured such that the pump 200 can selectively move the plug 400 to the expanded configuration by pumping hydraulic fluid into the plug 400. Regardless of the means by which the plug 400 is expanded, the plug 400 is selectively expanded by communication with the tool 200. The tool 200 may be programmed to locate and expand the plug 400 at a particular position in the wellbore 100 in some examples, or, as in the presently described example, may receive instructions via the electric wireline through a pre-determined communications protocol.

Once the plug 400 has been set at the desired location, the tool 200 can be released from the plug 400 by the operator selectively releasing the plug 400 from the tool 200 or by the tool 200 automatically releasing the plug 400 from the tool 200. In this connection, the tool 200 comprises a shear pin (not shown) releasably securing the plug 400 to the tool 200. When the plug 400 has been set and it is desired to release the plug 400 from the tool 200, the operator may lift the tool 200 on the electric wireline 300 with sufficient pull in the uphole direction such that the shear pin (not shown) breaks, thereby releasing the tool 200 from the plug 400. It will be understood that a selectively releasable connection between the plug 400 and tool 200 may be provided in a myriad of forms, and that the shear pin (not shown) used in the presently described example is merely one way of providing a selectively releasable attachment between the plug 400 and the tool 200. In other examples, a selectively releasable electro-mechanical latch may be provided to secure the plug 400 to the tool 200. In other examples, a selectively releasable hydraulic locking mechanism may be provided to secure the plug 400 to the tool 200.

Figure 4:
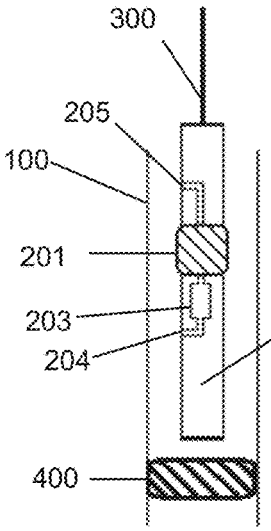
FIG. 4 shows the tool of FIG. 2 with the plug released from the tool.

Once the plug 400 has been released from the tool 200, the tool 200 can be lifted on the electric wireline 300 until the sealing element 201 is located at the desired location at which it will seal against the wellbore 100, as shown in FIG. 4. As previously explained, in some cases the plug 400 is set in a milled or otherwise extracted portion of a casing and/or liner and/or tubing and cement barrier (not shown). In this connection, the sealing element 201 may be expanded against the inside of the casing or tubing or liner or the sealing element 201 may also be expanded against the wellbore 100 in some examples. Regardless of the well component which the sealing element 201 abuts against, the sealing element 201 is moved from a collapsed to an expanded configuration to form a pressure tight seal. Communication with the sealing element 201 in the presently described example is via the electric wireline 300. It will be understood that the tool 200 may be run in and out of the wellbore 100 using an alternative method of suspending and delivering the tool 200, such as on drill pipe or slickline, i.e. non-electric wireline. Where in some alternative methods of suspending and delivering the tool 200 into the wellbore there may not be provided an electrical connection to the surface which can also carry communications, then another communications method may be provided. In some examples mud pulse telemetry, acoustic waves or radio waves may be used. In other examples any other known and commonly used downhole communications technique, the configuration of which would be well within the capabilities of a person skilled in the art, may be used.

Figure 5:
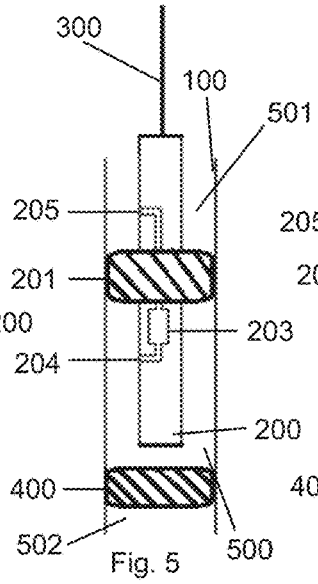
FIG. 5 shows the tool of FIG. 2 with the sealing element in the expanded configuration and the tool ready to perform a pressure test.

Once the sealing element 201 has been set in the expanded configuration shown in FIG. 5 an isolated volume 500 is created between the sealing element 201 and the plug 400. The isolated volume 500 is separate from a first volume 501 above the sealing element 201 and a second volume 502 below the plug 400. It will be understood that the upper volume 501 may be a volume of wellbore fluid, or may be another isolated volume for a different purpose. The lower volume 502 is a volume of wellbore fluid within the wellbore 100 which may include casing and/or liner and/or tubing and/or cement, as previously described.

The lower volume 502 may extend for several thousand meters below the plug 400. Due to the location of the sealing element 201 providing a pressure tight seal against the wellbore 100, and the location of the plug 400 providing a pressure tight seal against the wellbore 100 therebelow, changes (increases or decreases) in pressure in the isolated volume 500 are applied to the plug 400, allowing a pressure test to be conducted on the plug 400 by adjusting the pressure within the isolated volume 500. It should be noted that in the presently described example, the sealing element 201 is moved to the expanded configuration around 3 metres above the plug 400. In some examples the sealing element 201 may be located closer to the plug 400. In other examples, the sealing element 201 may be located a greater distance from the plug 400, for example 5 metres or 10 metres or 20 metres. It will be understood that the greater distance between the plug 400 and the sealing element 201, the more wellbore fluid has to be extracted or injected to perform a pressure test on the plug 400, as will now be described.

As shown in FIG. 5, the pump 203 is connected to an inlet port 204 in fluid communication with the isolated volume 500 and an outlet port 205 in fluid communication with the upper volume 501. The pump 203 is configured to pump fluid from the isolated volume 500 to the upper volume 501, thereby reducing the pressure in the isolated volume 500 such that a negative pressure test on the plug 400 is conducted.

Alternatively to the arrangement shown in FIG. 5, the pump 203 may be configured to pump fluid from the isolated volume 500 to a reservoir within the tool 200, thereby reducing the pressure in the isolated volume 500 such that a negative pressure test on the plug 400 can be conducted.

Although not shown in FIG. 5, it will be understood that the pump 203 may be configured to pump fluid from the upper 501 volume to the isolated volume 500, thereby increasing the pressure in the isolated volume 500 such that a positive pressure test can be conducted. In this regard, the inlet port 204 shown in FIG. 5 would be replaced by an outlet port, and the outlet port 205 shown in FIG. 5 would be replaced by an inlet port. It will also be understood that the inlet port 204 and outlet port 205 may each have dual functionality, that is to say the inlet port 204 may act as an inlet port and the outlet port 205 may act as an outlet port when the pump 203 is pumping in one direction, and then the inlet port 204 may act as an outlet port and the outlet port 205 may act as an inlet port, such that the same inlet and outlet ports 204, 205 may be used to provide a positive and negative pressure test by simply reversing the direction of the pump 203. It will be well within the capabilities of a person skilled in the art to provide suitable modification to the inlet port 204 and outlet port 205 to provide this reversibility.

Referring again to the negative pressure testing arrangement shown in FIG. 5, as the pressure in the isolated volume 500 is reduced, the plug 400 is pressure tested, i.e. the sealing performance at the plug 400 is tested, and if not sufficient, wellbore fluid or hydrocarbons will flow through or past the plug 400 to inside the isolated volume 500, thereby confirming that the seal provided by the plug 400 is not sufficient. In such cases it is likely that the plug 400 would be reset, or a new plug 400 would be delivered to the wellbore 100, possibly with further milling or cleaning of the wellbore 100 area where the plug 400 is to be set.

The tool 200 may, in some examples (not shown in the Figures), comprise an upper pressure sensor configured to measure a pressure in the wellbore 100 above the sealing element 201, i.e. in the first volume 501. Alternatively, or additionally, the tool 200 may comprise an intermediate pressure sensor configured to measure a pressure in the isolated volume 500. Alternatively, or additionally, the plug 400 may comprise a lower pressure sensor configured to measure a pressure in the wellbore 100 below the plug 400, i.e. in the second volume 502. In this connection, the plug 400 may comprise a wireless communications means configured to communicate the pressure in the wellbore 100 below the plug 400, in the second volume 502, to the tool 200, with the tool 200 comprising a respectively configured similar wireless communications means for receiving the communication from the plug 400. Communication with the upper pressure sensor and intermediate pressure sensor may be configured to be via the electric wireline 300, or where an electric wireline 300 is not used in alternative examples, via mud pulse telemetry, radio waves, or any other known and commonly used downhole communications technique, the configuration of which would be well within the capabilities of a person skilled in the art.

Figure 6:
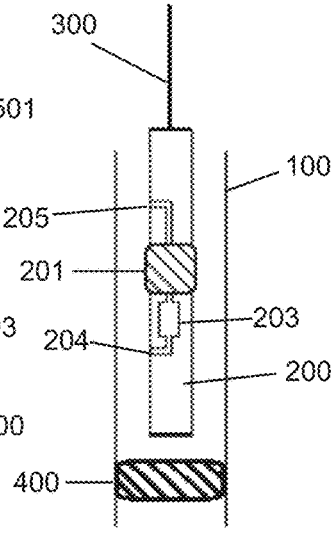
FIG. 6 shows the tool of FIG. 2 with the sealing element in the collapsed configuration and ready to run out of hole.

After one or more positive and/or negative pressure tests have been conducted with the sealing element 201 in the expanded configuration shown in FIG. 5, the sealing element 201 is moved to the collapsed configuration shown in FIG. 6. In the collapsed configuration, the sealing element 201 has a sufficiently slim profile such that the sealing element 201 can pass by any obstructions higher in the wellbore 100 such that the tool 200 can be removed from the wellbore 100. In some cases, such as in the presently described example, the sealing element 201 may not collapse to be completely flush with the body of the tool 200, and instead protrude slightly from the body of the tool 200.

Figure 7:
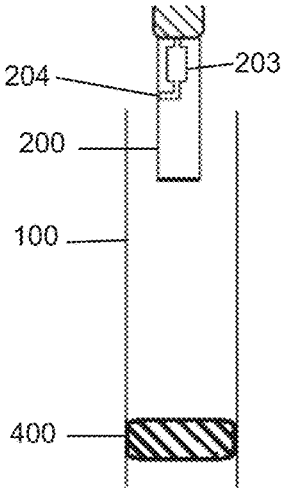
FIG. 7 shows the tool being run out of hole with the plug left in the expanded configuration in the wellbore.
Figure 8:
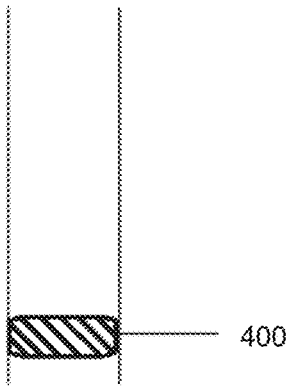
FIG. 8 shows the plug left in the wellbore.

As shown in FIG. 7, the tool 200 is then lifted from within the wellbore 100. In some cases, the tool 200 may be lifted to another location in the wellbore 100 where a pressure test is to be performed. In other cases, the tool 200 is lifted out of the wellbore 100. As can be seen in FIG. 8, when the tool 200 is removed from the wellbore 100 completely, or from the vicinity of the plug 400, the plug 400 is left in the wellbore 100 in the expanded configuration.

The above-mentioned system and method therefore deliver the plug 400 to the wellbore 100 and allow pressure testing of the plug 400 in a single trip. That is to say, the tool 200 and plug 400 are introduced into the wellbore 100 and run in to the wellbore 100 on the same electric wireline 300 at the same time, as opposed to running the plug 400 firstly and setting the plug 400 at the desired depth, and then running the tool 200 to perform the pressure testing of the plug 400.

Referring again to the selectively releasable attachment between the tool 200 and the plug 400 previously discussed. It will be understood that in some examples the selectively releasable attachment may also be capable of selectively reattaching the tool 200 to the plug 400 should the plug 400 fail the positive and/or negative pressure test, or should the plug 400 need to be moved or retrieved for another reason. In this connection, it would be highly desirable to retrieve the plug 400 at the same time as the tool 200 is removed from the wellbore 100. To do so, the tool 200 may comprise a selectively attachable attachment means, which may be incorporated into the selectively releasable attachment means or may be a separate component. That is to say, the attachment provided between the tool 200 and the plug 400 when the tool 200 and plug 400 are run into the wellbore 100 may be configured to selectively release the plug 400 from the tool 200 and selectively reattach the plug 400 to the tool 200. Alternatively, the selectively releasable attachment means and selectively attachable attachment means may be two separate components. Where the tool 200 is configured to reattached to the plug 400, the tool 200 is configured to also move the plug 400 from the expanded configuration to the collapsed configuration, thereby allowing the tool 200 to be able to lift the collapsed plug 400 through the wellbore 100 to the surface.

It will be within the capabilities of a person skilled in the art to determine suitable increases and/or decreases in pressure in the above-mentioned examples and in further examples not illustrated. As an example only, a pressure differential across the plug 400 of between 3000 kPa and 15,000 kPa may be used, for example a pressure differential of 10,000 kPa may be used.

It will be appreciated that the pressure adjustment means shown is an example of a suitable pressure adjustment means. However, other pressure adjustment means may also be used. As another non-limiting example, the pressure adjustment means may be configured to increase or decrease the pressure in the isolated volume 500 by use of a pressure adjustment chamber in the tool 200. In this configuration, the pressure in the isolated volume 500 may be adjusted by extracting fluid from the isolated volume 500 into the pressure adjustment chamber to decrease the pressure in the isolated volume 500, or by delivering fluid to the isolated volume 500 from the pressure adjustment chamber to increase the pressure in the isolated volume 500. In some examples, the pressure adjustment chamber may be located inside the tool 200, or alternatively the pressure adjustment chamber may be located on an external surface of the tool 200.

Referring now to FIGS. 1*a* to 9*a*, an alternative example of a tool 200*a* is now described. The tool 200*a* comprises many similar features to the tool 200 described with reference to FIGS. 1 to 9, therefore like reference numerals (followed by "a") are used to indicate like parts. However, the tool 200*a* is described in FIGS. 1*a* to 9*a* being delivered into a tubing string 100*a* to deliver and pressure test a plug 400*a* and an annular region behind the tubing, as is now explained.

Figure 1A:
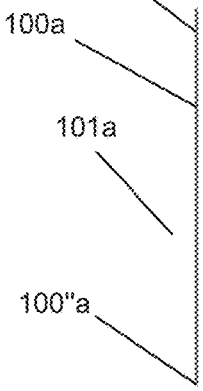
FIG. 1*a* shows a schematic of a tubing string.

FIG. 1*a* shows a simplified schematic of a portion of a tubing string 100*a* configured within formation 101*a*. The tubing string 100*a* extends from an uphole end 100'*a* to a downhole end 100"*a*. In the presently described example the portion of the tubing string 100*a* provided in FIGS. 1*a* to 9*a* is where a plug is to be set and where at least one aperture is to be punched in the tubing to allow testing of the annulus behind the tubing string 100*a*, as will be described in detail.

It will be understood by those skilled in the art that a myriad of equipment may be used in the tubing string 100*a* which is omitted here in the interest of clarity.

Figure 2A:
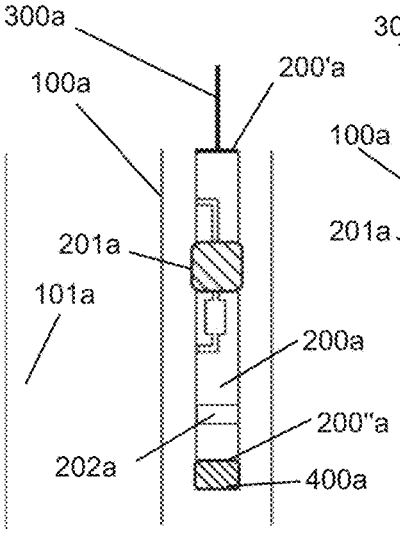
FIG. 2*a* shows the plug delivery and pressure test tool with the plug being run into the tubing string.

Referring now to FIG. 2*a*, a tool 200*a* has been run into the tubing string 100*a*. The tool 200*a* has been lowered into the tubing string 100*a* on an electric wireline 300*a* which provides power and communications between the tool 200*a* and the surface such that operators of the tool 200*a* at the surface can control the tool 200*a*, as is well known in the art.

The tool 200*a* comprises a sealing element 201*a* which is configured to be operatively engageable with the internal surface of the tubing string 100*a* when in use in the tubing string 100*a*. The sealing element 201*a* is an expandable packer in the presently described example. In other examples (not shown) the sealing element 201*a* may be a conformable packer. It will be understood that the sealing element 201*a* may be any component configured to be movable from a collapsed configuration, which allows the tool 200*a* to be run into the tubing string 100*a* without forming a seal with the tubing string 100*a* and then moved to an expanded configuration, as will be explained with reference to later Figures.

Still referring to FIG. 2*a*, the tool 200*a* has an uphole end 200'*a* and a downhole end 200"*a*. The electric wireline 300*a* is attached at the uphole end 200'*a* of the tool 200*a* such that the tool 200*a* can be lowered and lifted inside the tubing string 100*a*, and such that a force in the uphole direction can be applied to the tool 200*a* when required, as will be explained later.

Still referring to FIG. 2*a*, the tool 200*a* further comprises a tubing puncher 202*a* configured to selectively punch apertures in the tubing string 100*a* such that the annulus behind the tubing string 100*a* can be accessed and tested from inside the tubing string 100*a*.

In the presently described example, the tubing puncher 202*a* is a component of the tool 200*a*. It will be understood that in other examples the tubing puncher 202*a* may be provided as a separate component run in a string with the tool 200*a*. In such examples, the tubing puncher 202*a* may be connected to the tool 200*a* at the uphole end 200'*a* between the tool 200*a* and the wireline 300*a*, for example. It will be understood that other tools (not shown) may also be configured in the tool string, and the puncher 202*a* may be provided anywhere in the string in some examples. In examples where the puncher 202*a* is located above the tool 200*a*, the puncher 202*a* may be operated to perform a punching operation on the tubing string 100*a* before the tool 200*a* is lifted such that the sealing element 201*a* is above the punched apertures in the tubing string 100*a*, the purpose of which will be explained later. It is preferable that as in the presently described example shown in FIGS. 2*a* to 8*a*, the tubing puncher 202*a* is provided as a component of the tool 200*a* between the sealing element 201*a* and the downhole end 200"*a*, such that the sealing element 201*a* does not need to be lifted past the location of the punched apertures after the punching operation, as is required where the tubing puncher 202*a* is provided above the tool 200*a* in the tool string.

Figure 3A:
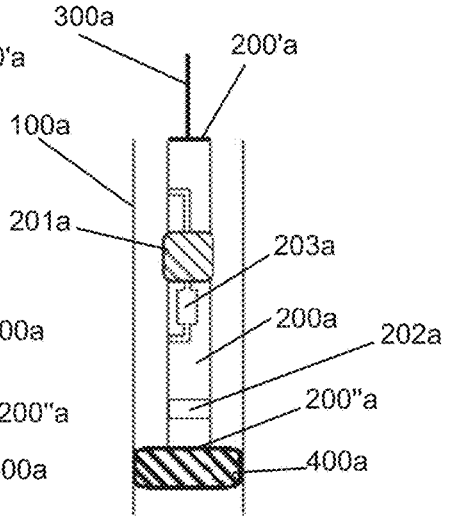
FIG. 3*a* shows the tool of FIG. 2*a* with the plug in the expanded configuration.

Still referring to FIG. 2*a*, at the downhole end 200"*a* there is releasably attached a selectively expandable plug 400*a*. The plug 400*a* is attached to the tool 200*a* such that the plug 400*a* can be lowered into the tubing string 100*a* to a desired position where the plug 400*a* should be set, i.e. expanded, to provide a seal across the tubing string 100*a*, as is shown in FIG. 3*a*. The plug 400*a* in the presently described example is an expandable packer. However, in other examples (not shown) the plug 400*a* may be a conformable packer. It will be understood that the plug 400*a* may be any component configured to be movable from a collapsed configuration, which allows the plug 400*a* to be run into the tubing string 100*a* without forming a seal with the tubing string 100*a* and then moved to an expanded configuration shown in FIG. 3*a* to form a pressure tight seal against the tubing string 100*a*. In this connection, the plug 400*a* may be operated in some examples by electrical connection (not shown) between the tool 200*a* and the plug 400*a* to move the plug 400*a* to the expanded configuration.

In other examples (not shown) hydraulic pressure may be provided by a pump 203*a* in the tool 200*a* with a connection (not shown) between the pump 203*a* and the plug 400*a* configured such that the pump 200*a* can selectively move the plug 400*a* to the expanded configuration by pumping hydraulic fluid into the plug 400*a*. Regardless of the means by which the plug 400*a* is expanded, the plug 400*a* is selectively expanded by communication with the tool 200*a*. The tool 200*a* may be programmed to locate and expand the plug 400*a* at a particular position in the tubing string 100*a* in some examples, or, as in the presently described example, may receive instructions via the electric wireline through a pre-determined communications protocol.

Once the plug 400*a* has been set at the desired location, the tool 200*a* can be released from the plug 400*a* by the operator selectively releasing the plug 400*a* from the tool 200*a* or by the tool 200*a* automatically releasing the plug 400*a* from the tool 200*a*. In this connection, the tool 200*a* comprises a shear pin (not shown) releasably securing the plug 400*a* to the tool 200*a*. When the plug 400*a* has been set and it is desired to release the plug 400*a* from the tool 200*a*, the operator may lift the tool 200*a* on the electric wireline 300*a* with sufficient pull in the uphole direction such that the shear pin (not shown) breaks, thereby releasing the tool 200*a* from the plug 400*a*. It will be understood that a selectively releasable connection between the plug 400*a* and tool 200*a* may be provided in a myriad of forms, and that the shear pin (not shown) used in the presently described example is merely one way of providing a selectively releasable attachment between the plug 400*a* and the tool 200*a*. In other examples, a selectively releasable electro-mechanical latch may be provided to secure the plug 400*a* to the tool 200*a*. In other examples, a selectively releasable hydraulic locking mechanism may be provided to secure the plug 400*a* to the tool 200*a*.

Figure 4A:
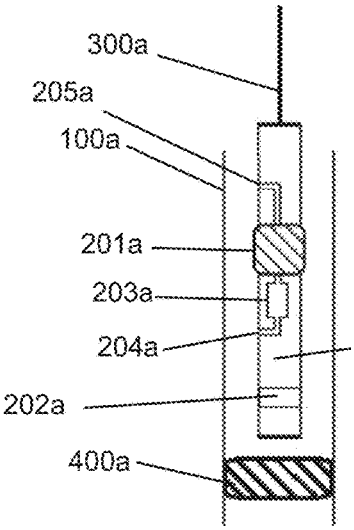
FIG. 4*a* shows the tool of FIG. 2*a* with the plug released from the tool.

Once the plug 400*a* has been released from the tool 200*a*, the tool 200*a* can be lifted on the electric wireline 300*a* until the tubing puncher 202*a* is located at the desired location at which it will form apertures in the tubing string 100*a*, as shown in FIG. 4*a*. In some examples, it may not be necessary to lift the tool 200*a* at this stage if the tubing puncher 202*a* is already located at a suitable location to form apertures in the tubing string 100*a*. Furthermore, it will be appreciated that the tubing puncher 202*a* may form apertures in the tubing string 100*a* before the plug 400*a* is released from the tool 200*a* in some examples.

Figure 5A:
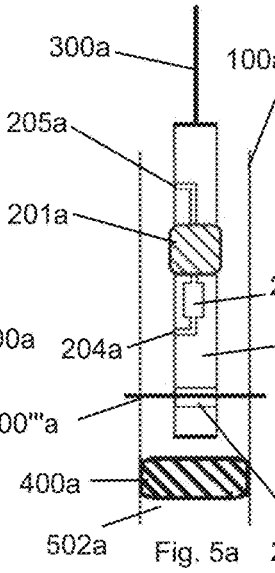
FIG. 5*a* shows the tool of FIG. 2*a* with a tubing puncher in the tool activated to form apertures in the tubing string.

When the tubing puncher 202*a* is at the location where it is desired to form apertures in the tubing string 100*a*, the tubing puncher 202*a* is activated (as shown in FIG. 5*a*) to form apertures 100"*a* through the tubing string 100*a* (FIG. 6*a*) to allow fluid communication between the inside of the tubing string 100*a* and the formation 101*a* or annulus surrounding the tubing string 100*a*.

Figure 6A:
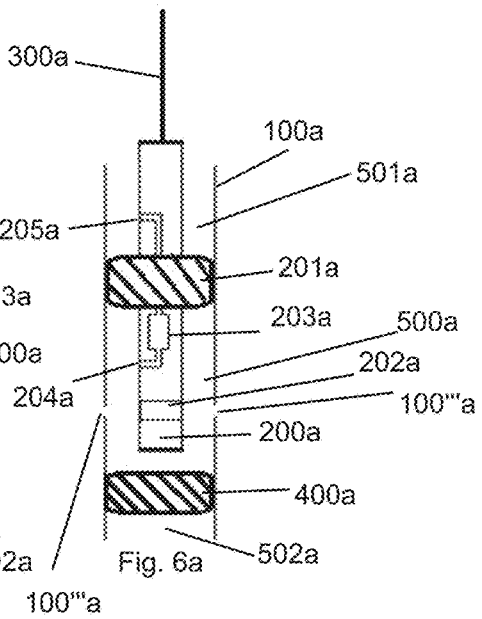
FIG. 6*a* shows the tool of FIG. 2*a* with the sealing element in the expanded configuration and the tool ready to perform a pressure test.

The sealing element 201*a* is then expanded against the inside of the tubing string 100*a* by moving the sealing element 201*a* from a collapsed to an expanded configuration to form a pressure tight seal (FIG. 6*a*). Communication with the sealing element 201*a* in the presently described example is via the electric wireline 300*a*. It will be understood that the tool 200*a* may be run in and out of the tubing string 100*a* using an alternative method of suspending and delivering the tool 200*a*, such as on drill pipe or slickline, i.e. non-electric wireline. Where in some alternative methods of suspending and delivering the tool 200*a* into the tubing string 100*a* there may not be provided an electrical connection to the surface which can also carry communications, then another communications method may be provided. In some examples mud pulse telemetry, acoustic waves or radio waves may be used. In other examples any other known and commonly used downhole communications technique, the configuration of which would be well within the capabilities of a person skilled in the art, may be used.

Once the sealing element 201*a* has been set in the expanded configuration shown in FIG. 6*a* an isolated volume 500*a* is created between the sealing element 201*a* and the plug 400*a*. The isolated volume 500*a* spans the apertures 100"*a* such that the annulus or formation behind the tubing string 100*a* can be pressure tested by adjustment of the pressure in the isolated volume 500*a*.

The isolated volume 500*a* is separate from a first volume 501*a* above the sealing element 201*a* and a second volume 502*a* below the plug 400*a*. It will be understood that the upper volume 501*a* may be a volume of wellbore fluid for example, or may be another isolated volume for a different purpose. The lower volume 502*a* may be a volume of wellbore fluid within the tubing string 100*a*. It will be understood that a plug may be set within a tubing string for myriad reasons and with myriad possible fluids within the tubing string 100*a* prior to setting. The term wellbore fluid here is used to refer to all possible fluids that may be within the tubing string 100*a* at the time of setting a barrier, i.e. a plug, across the tubing string 100*a* and is not intended to refer to a particular type of fluid. In this connection, it is not important what type of fluid is contained in the lower volume 502*a* below the plug 400*a*.

The lower volume 502*a* may extend for several thousand meters below the plug 400*a*. Due to the location of the sealing element 201*a* providing a pressure tight seal against the tubing string 100*a*, and the location of the plug 400*a* providing a pressure tight seal against the tubing string 100*a* therebelow, changes (increases or decreases) in pressure in the isolated volume 500*a* are applied to the plug 400*a* and the annulus or formation outside of the tubing string 100*a* in the locality of the apertures 100'"*a* formed by the tubing puncher 202*a*, allowing a pressure test to be conducted on the plug 400*a* and the annulus or formation by adjusting the pressure within the isolated volume 500*a*. It should be noted that in the presently described example, the sealing element 201*a* is moved to the expanded configuration around 3 metres above the plug 400*a*. In some examples the sealing element 201*a* may be located closer to the plug 400*a*. In other examples, the sealing element 201*a* may be located a greater distance from the plug 400*a*, for example 5 metres or 10 metres or 20 metres. It will be understood that the greater distance between the plug 400*a* and the sealing element 201*a*, the more wellbore fluid has to be extracted or injected to perform a pressure test on the plug 400*a* and the annulus or formation, as will now be described.

As shown in FIG. 6*a*, the pump 203*a* is connected to an inlet port 204*a* in fluid communication with the isolated volume 500*a* and an outlet port 205*a* in fluid communication with the upper volume 501*a*. In the same way as previously described, the pump 203 pumps fluid from the isolated volume 500*a* to the upper volume 501*a*, thereby reducing the pressure in the isolated volume 500*a* such that a negative pressure test on the plug 400 and annulus or formulation is conducted.

Alternatively, the pump 203*a* may be configured to pump fluid from the isolated volume 500*a* to a reservoir within the tool 200*a*, thereby reducing the pressure in the isolated volume 500*a* such that a negative pressure test on the plug 400*a* and annulus or formation can be conducted.

Although not shown in FIG. 6*a*, it will be understood that the pump 203*a* may be configured to pump fluid from the upper 501*a* volume to the isolated volume 500*a*, thereby increasing the pressure in the isolated volume 500*a* such that a positive pressure test can be conducted. In this regard, the inlet port 204*a* shown in FIG. 6*a* would be replaced by an outlet port, and the outlet port 205*a* shown in FIG. 6*a* would be replaced by an inlet port. It will also be understood that the inlet port 204*a* and outlet port 205*a* may each have dual functionality, that is to say the inlet port 204*a* may act as an inlet port and the outlet port 205*a* may act as an outlet port when the pump 203*a* is pumping in one direction, and then the inlet port 204*a* may act as an outlet port and the outlet port 205*a* may act as an inlet port, such that the same inlet and outlet ports 204*a*, 205*a* may be used to provide a positive and negative pressure test by simply reversing the direction of the pump 203*a*. It will be well within the capabilities of a person skilled in the art to provide suitable modification to the inlet port 204*a* and outlet port 205*a* to provide this reversibility.

Referring again to the negative pressure testing arrangement shown in FIG. 6*a*, as the pressure in the isolated volume 500*a* is reduced, the plug 400*a* and annulus or formation is pressure tested, i.e. the sealing performance at the plug 400*a* is tested and the annulus or formation is negatively pressure tested to ensure that fluid does not flow through the annulus or formation when exposed to such negative pressure, and if not sufficient, wellbore fluid or hydrocarbons will flow through or past the plug 400 or through the annulus or formation to inside the isolated volume 500*a*, thereby confirming that the seal provided by the plug 400*a* is not sufficient or the annulus or formation is not sufficiently isolated. In such cases it is likely that remedial action would be taken to reset the plug 400*a* and/or improve the sealing in the annulus by for example performing a cement job.

The tool 200*a* may, in some examples (not shown in the Figures), comprise an upper pressure sensor configured to measure a pressure in the tubing string 100*a* above the sealing element 201*a*, i.e. in the first volume 501*a*. Alternatively, or additionally, the tool 200*a* may comprise an intermediate pressure sensor configured to measure a pressure in the isolated volume 500*a*. Alternatively, or additionally, the plug 400*a* may comprise a lower pressure sensor configured to measure a pressure in the tubing string 100*a* below the plug 400*a*, i.e. in the second volume 502*a*. In this connection, the plug 400*a* may comprise a wireless communications means configured to communicate the pressure in the tubing string 100*a* below the plug 400*a*, in the second volume 502*a*, to the tool 200*a*, with the tool 200*a* comprising a respectively configured similar wireless communications means for receiving the communication from the plug 400*a*. Communication with the upper pressure sensor and intermediate pressure sensor may be configured to be via the electric wireline 300*a*, or where an electric wireline 300*a* is not used in alternative examples, via mud pulse telemetry, radio waves, or any other known and commonly used downhole communications technique, the configuration of which would be well within the capabilities of a person skilled in the art.

Figure 7A:
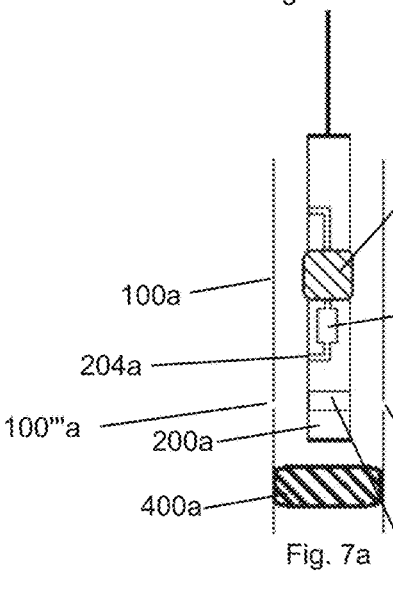
FIG. 7*a* shows the tool of FIG. 2*a* with the sealing element in the collapsed configuration and ready to run out of the tubing string.

After one or more positive and/or negative pressure tests have been conducted with the sealing element 201*a* in the expanded configuration shown in FIG. 6*a*, the sealing element 201*a* is moved to the collapsed configuration shown in FIG. 7*a*. In the collapsed configuration, the sealing element 201*a* has a sufficiently slim profile such that the sealing element 201*a* can pass by any obstructions higher in the tubing string 100*a* such that the tool 200*a* can be removed from the tubing string 100*a*. In some cases, such as in the presently described example, the sealing element 201*a* may not collapse to be completely flush with the body of the tool 200*a*, and instead protrude slightly from the body of the tool 200*a*.

Figure 8A:
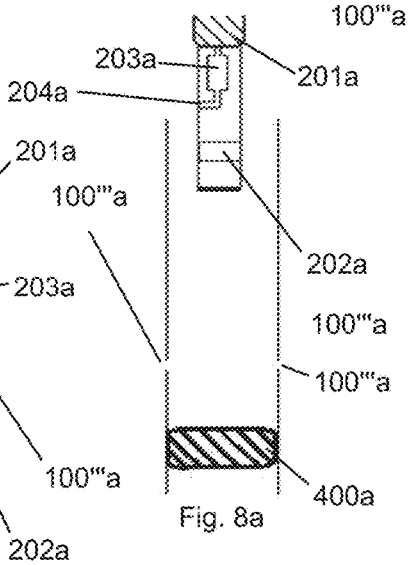
FIG. 8*a* shows the tool being run out of the tubing string with the plug left in the expanded configuration in the tubing string.
Figure 9A:
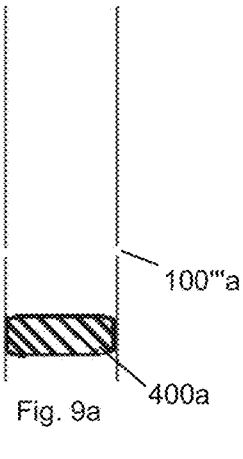
FIG. 9*a* shows the plug left in the tubing string.

As shown in FIG. 8*a*, the tool 200*a* is then lifted from within the tubing string 100*a*. In some cases, the tool 200*a* may be lifted to another location in the tubing string 100*a* where a pressure test is to be performed. In other cases, the tool 200*a* is lifted out of the tubing string 100*a*. As can be seen in FIG. 9*a*, when the tool 200*a* is removed from the tubing string 100*a* completely, or from the vicinity of the plug 400*a*, the plug 400*a* (in the expanded configuration) and apertures 100"*a* are left in the tubing string 100*a*.

The above-mentioned system and method therefore deliver the plug 400*a* to the tubing string 100*a* and allow pressure testing of the plug 400*a* and the annulus or formation behind the tubing string 100*a* in a single trip. That is to say, the tool 200*a*, plug 400*a* and tubing puncher 202*a* are introduced into the tubing string 100*a* and run in to the tubing string 100*a* on the same electric wireline 300*a* at the same time, as opposed to running the tubing punch 202*a* firstly, and then the plug, and then running the tool 200*a* to perform the pressure testing of the plug 400*a* and the annulus or formation behind the tubing string 100*a*.

It will be understood that the above-described method is just one way of using the tool 200*a* and that other ways of performing a tubing punching operation and pressure testing of the plug 400*a* and the annulus or formation behind the tubing string 100*a* in a single trip may be performed using the tool 200*a*. Some non-limiting examples of such methods are now described.

In a first alternative example, the tool 200*a* may be run into the tubing string 100*a* and the tubing puncher 202*a* may be operated to form apertures in the tubing string 100*a* before the plug 400*a* is set. After the formation of apertures using the tubing puncher 202*a* and the setting of the plug 400*a*, the plug 400*a* and annulus or formation behind the tubing string 100*a* can be pressure tested in the manner previously described.

In a second alternative example, the tool 200*a* may be run into the tubing string 100*a* and the plug 400*a* may be set as previously described. In this example, there is an intermediate step of pressure testing the plug 400*a* within the tubing string 100*a*. This may be substantially as is performed in FIG. 5 but for the tubing string 100*a* rather than the wellbore 100. After pressure testing the plug 400*a* in the tubing string 100*a*, the puncher 202*a* can be operated to form apertures in the tubing string 100*a*. After the setting of the plug 400*a*, pressure testing of the plug 400*a* in the tubing string 100*a* and formation of apertures using the tubing puncher 202*a*, the plug 400*a* and annulus or formation behind the tubing string 100*a* can be pressure tested in the manner previously described. This method allows the plug 400*a* integrity to be verified before apertures are punched in the tubing string 100*a* using the tubing puncher 202*a*.

The releasable attachment between the tool 200*a* and the plug 400*a* may be substantially as described in any of the examples discussed with reference to FIGS. 1 to 9, therefore the details are not described again in the interest of brevity.Again, it will be within the capabilities of a person skilled in the art to determine suitable increases and/or decreases in pressure in the above-mentioned examples and in further examples not illustrated. As an example only, a pressure differential across the plug 400*a* and the apertures 100"*a* of between 3000 kPa and 15,000 kPa may be used, for example a pressure differential of 10,000 kPa may be used.

Referring now to FIGS. 1*b* to 8*b*, an alternative example of a tool 200*b* is now described. The tool 200*b* comprises many similar features to the tool 200*a* described with reference to FIGS. 1*a* to 9*a*, therefore like reference numerals (followed by "b" rather than "a") are used to indicate like parts. In this connection, the tool 200*b* is for use in a tubing string 100*b* to deliver a plug 400*b* and make a cut in the tubing string 100*b*. The tool 100*b* is again run on electric wireline 300*b*. The tubing string 100*b* is configured within the formation 101*b* and extends from an uphole end 100'*b* to a downhole end 100"*b*. The tool 200*a* comprises a sealing element 201*b* as described in the previous examples, an uphole end 200'*b* and a downhole end 200"*b* and a tubing cutter 202*b* configured to selectively cut the tubing string 100*b* in preparation for subsequent removal of a portion of the tubing string 100*b*. To stabilise the tubing cutter 202*b* and allow rotation of the tubing cutter 202*b* to perform the cut, there is also provided an expandable anchor 202'*b* which can be selectively expanded into engagement with the tubing string 100*b* when required. Furthermore, as described in detail with reference to previous examples, the tool 200*b* comprises an inlet port 204*b*, an outlet port 205*b* and a pump 203*b* to be able to perform a pressure test in the manner previously described.

In the presently described example, the tubing cutter 202*b* is a component of the tool 200*b*. It will be understood that in other examples the tubing cutter 202*b* may be provided as a separate component run in a string with the tool 200*b*. In such examples, the tubing cutter 202*b* may be connected to the tool 200*b* at the uphole end 200'*b* between the tool 200*b* and the wireline 300*b*, for example.

Once the plug 400*b* has been run in and released from the tool 200*b* and a pressure test has been performed in a similar manner to that previously explained with reference to the previous examples, the tool 200*b* can be lifted on the electric wireline 300*b* until the tubing cutter 202*b* is located at the desired location at which it will cut the tubing string 100*b*. The tubing string 100*b* can then be cut before the tool 200*b* is removed from the tubing string 100*b*, thus saving a subsequent trip to cut the tubing string 100*b* after the plug 400*b* has been set and the pressure test has been performed.

Figure 1B:
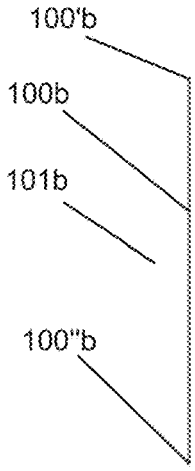
FIG. 1*b* shows a schematic of a tubing string.
Figure 2B:
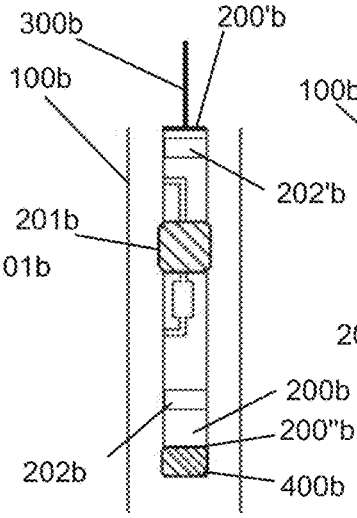
FIG. 2*b* shows the plug delivery and pressure test tool with the plug being run into the tubing string.
Figure 3B:
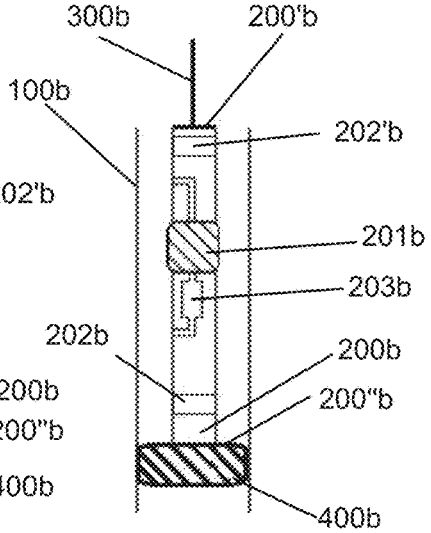
FIG. 3*b* shows the tool of FIG. 2*b* with the plug in the expanded configuration.
Figure 4B:
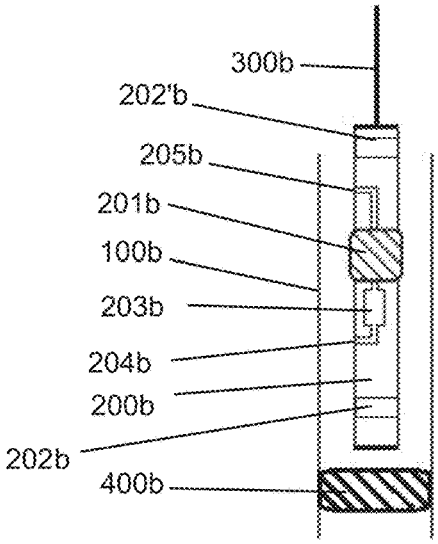
FIG. 4*b* shows the tool of FIG. 2*b* with the plug released from the tool.
Figure 5B:
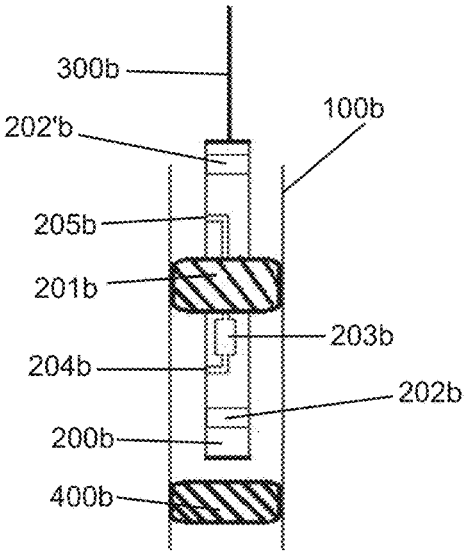
FIG. 5*b* shows the tool of FIG. 2*b* with the sealing element in the expanded configuration and the tool ready to perform a pressure test.
Figure 6B:
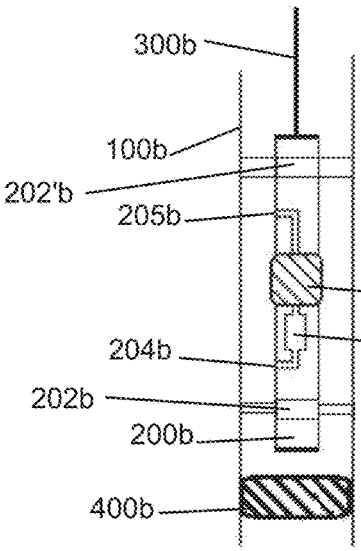
FIG. 6*b* shows the tool of FIG. 2*b* with a tubing cutter in the tool activated to form apertures in the tubing string.
Figure 7B:
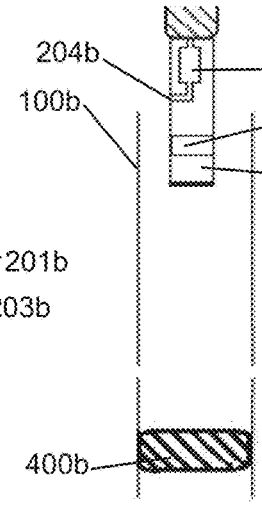
FIG. 7*b* shows the tool being run out of the tubing string with the plug left in the expanded configuration in the tubing.
Figure 8B:
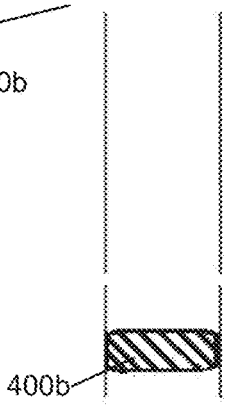
FIG. 8*b* shows the plug left in the tubing string.

The process is now briefly explained with reference to each of FIGS. 1*b* to 8*b* in turn. In FIG. 1*b* the tubing string 100*b* is ready to receive a plug and thereafter be cut ready for subsequent removal of a portion of the tubing string 100*b*. In FIG. 2*b* the tool 200*b* is delivered into the tubing string 100*b* at the depth at which it is desired to set the plug 400*b*. In FIG. 3*b* the plug 400*b* is expanded against the tubing string 100*b*. In FIG. 4*b* the plug 400*b* is detached from the tool 200*b* and the tool 200*b* is lifted to the desired location to set the sealing element 201*b* and the sealing element 201*b* is then set as shown in FIG. 5*b*. A pressure test is then performed utilising the pump 203*b* and the inlet 204*b* and outlet 205*b* ports. After the pressure test is complete, the sealing element 201*b* is collapsed and the cutting of the tubing string 100*b* can commence. The anchor 202'*b* is expanded against the tubing string 100*b* and the tubing cutter 202*b* performs a cutting operation thereby forming a continuous cut 100"*b* in the tubing string 100*b* (FIG. 7*b*). The anchor 202'*b* and tubing cutter 202*b* can be collapsed into the tool 200*b* and the tool 200*b* is then raised out of the tubing string 100*b* leaving the pressure tested plug 400*b* and the cut 100"*b* in the tubing string 100*b*, as shown in FIG. 8*b*. It will be appreciated that the setting and pressure testing of the plug 400*b* and cutting of the tubing string 100*b* in one trip may provide significant time savings.

In highly deviated or horizontal wells, a wireline tractor may be used to deliver the tool 200, 200*a*, 200*b* and plug 400, 400*a*, 400*b*. It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

CLAUSES

CLAUSE 1. A plug delivery and pressure test tool for delivering a plug to a wellbore or tubular and pressure testing the plug in a single trip, the tool comprising: an uphole end and a downhole end; a sealing element; a pressure adjustment means; and a plug attachment means located at or near the downhole end; wherein the plug attachment means is configured to carry a selectively expandable plug to a desired location in the wellbore or tubular and selectively release the plug from at or near the downhole end of the tool; the sealing element is configured to seal against an internal surface of the wellbore or tubular in use, thereby creating an isolated volume in use, between the sealing element and the plug; and the pressure adjustment means is configured to increase or decrease the pressure in the isolated volume, in use, thereby creating a pressure differential across the plug to perform a pressure test of the plug.

CLAUSE 2. The tool according to clause 1, wherein the pressure adjustment means is configured in use to adjust the pressure in the isolated volume by either: moving fluid from the isolated volume to an upper fluid volume above the sealing element to create an underbalance in the isolated volume, thereby negatively pressure testing the plug or moving fluid from an upper fluid volume above the sealing element to the isolated volume to create an overbalance in the isolated volume, thereby positively pressure testing the plug.

CLAUSE 3. The tool according to clause 1 or 2, wherein the pressure adjustment means is a pump or a piston or a pressure adjustment chamber.

CLAUSE 4. The tool according to any preceding clause, wherein the sealing element is an expandable or conformable packer.

CLAUSE 5. The tool according to any preceding clause, wherein the sealing element is expandable from a collapsed configuration to an expanded configuration, wherein in the collapsed configuration the sealing element is configured to be run into a wellbore or tubular without forming a seal with the internal surface of the wellbore or tubular, and in the expanded configuration the sealing element is configured to form a seal with the internal surface of the wellbore or tubular.

CLAUSE 6. The tool according to any preceding clause, further comprising: a fluid inlet port; and a fluid outlet port; wherein the fluid inlet port is located between the sealing element and the plug attachment means, and is in fluid communication with the pressure adjustment means, and the fluid outlet port is located between the sealing element and the uphole end of the tool, and is in fluid communication with the pressure adjustment means.

CLAUSE 7. The tool according to any of clauses 1 to 5, further comprising: a fluid inlet port; and a fluid outlet port; wherein the fluid outlet port is located between the sealing element and the plug attachment means, and is in fluid communication with the pressure adjustment means, and the fluid inlet port is located between the sealing element and the uphole end of the tool, and is in fluid communication with the pressure adjustment means.

CLAUSE 8. The tool according to any of clauses 1 to 5, further comprising: a first fluid inlet and outlet port; and a second fluid inlet and outlet port; wherein the first fluid inlet and outlet port is located between the sealing element and the plug attachment means, and is in fluid communication with the pressure adjustment means, and the second fluid inlet and outlet port is located between the sealing element and the uphole end of the tool, and is in fluid communication with the pressure adjustment means.

CLAUSE 9. The tool according to any preceding clause, further comprising: an upper pressure sensor configured to measure a pressure in the wellbore or tubular between the sealing element and the uphole end of the tool or at the uphole end of the tool in use, and/or; an intermediate pressure sensor configured to measure a pressure in the isolated volume in use.

CLAUSE 10. The tool according to any preceding clause, wherein the plug attachment means comprises a shear pin and/or electromechanical latch and/or hydraulic locking mechanism.

CLAUSE 11. The tool according to any preceding clause, wherein the plug attachment means is configured in use to selectively reattach the plug at or near the downhole end of the tool and carry the plug to a desired location in the wellbore or tubular.

CLAUSE 12. A system for delivering and pressure testing a plug in a wellbore or tubular in a single trip, the system comprising: a tool according to any of clauses 1 to 11; a selectively expandable plug; wherein the plug is configured to be releasably attached to the plug attachment means in use.

CLAUSE 13. The system according to clause 12, wherein the plug is configured to seal against an internal surface of the wellbore or tubular in use, thereby creating a pressure tight seal.

CLAUSE 14. The system according to clause 12 or 13, wherein the plug is an expandable or conformable packer.

CLAUSE 15. The system according to any of clauses 12 to 14, wherein the plug is expandable from a collapsed configuration to an expanded configuration, wherein in the collapsed configuration the plug is configured to be run into a wellbore or tubular without forming a seal with the internal surface of the wellbore or tubular, and in the expanded configuration the plug is configured to form a seal with the internal surface of the wellbore or tubular.

CLAUSE 16. The system according to any of clauses 12 to 15, wherein the plug is configured to be reattachable to the tool in use after the plug has been released from the tool.

CLAUSE 17. The system according to any of clauses 12 to 16, wherein the plug comprises a lower pressure sensor configured to measure a pressure in the wellbore or tubular below the plug in use.

CLAUSE 18. A method of assembling a system for delivering a plug to a wellbore and performing a pressure test on the plug in a single trip, comprising the steps of: providing a tool according to any of clauses 1 to 11; providing a selectively expandable plug configured to be releasably attached to the plug attachment means of the tool; and releasably attaching the plug to the plug attachment means.

CLAUSE 19. A method of setting and pressure testing a plug in a single trip, comprising the steps of: providing a system according to any of clauses 12 to 17; releasably attaching the plug to the plug attachment means; running the system into a wellbore or tubular to a desired location in the wellbore or tubular; moving the plug to the expanded configuration to form a pressure tight seal in the wellbore or tubular; releasing the plug from the plug attachment means; lifting the tool uphole in the wellbore or tubular; moving the sealing element to the expanded configuration to form a pressure tight seal in the wellbore or tubular, thereby creating an isolated volume; and activating the pressure adjustment means to increase or decrease the pressure in the isolated volume, thereby pressure testing the plug.

CLAUSE 20. A method of pressure testing and setting a plug in a single trip, comprising the steps of: providing a system according to any of clauses 12 to 17; releasably attaching the plug to the plug attachment means; running the system into a wellbore or tubular to a desired location in the wellbore or tubular; moving the plug to the expanded configuration to form a pressure tight seal in the wellbore or tubular; moving the sealing element to the expanded configuration to form a pressure tight seal in the wellbore or tubular, thereby creating an isolated volume; activating the pressure adjustment means to increase or decrease the pressure in the isolated volume, thereby pressure testing the plug; and releasing the plug from the plug attachment means.

CLAUSE 21. A method of pressure testing and setting a plug in a single trip, comprising the steps of: providing a system according to any of clauses 12 to 17; releasably attaching the plug to the plug attachment means; running the system into a wellbore or tubular to a desired location in the wellbore or tubular; moving the sealing element to the expanded configuration to form a pressure tight seal in the wellbore or tubular; moving the plug to the expanded configuration to form a pressure tight seal in the wellbore or tubular, thereby creating an isolated volume; activating the pressure adjustment means to increase or decrease the pressure in the isolated volume, thereby pressure testing the plug; and releasing the plug from the plug attachment means.

The invention claimed is:

1. A plug delivery and pressure test tool for delivering a plug to a wellbore or tubular and pressure testing the plug in a single trip, the tool comprising:

an uphole end and a downhole end;

a sealing element;

a pressure adjustment means; and a plug attachment means located at or near the downhole end;

wherein the plug attachment means is configured to carry a selectively expandable plug to a desired location in the wellbore or tubular and selectively release the plug from at or near the downhole end of the tool;

the sealing element is configured to seal against an internal surface of the wellbore or tubular in use, thereby creating an isolated volume in use, between the sealing element and the plug; and wherein the pressure adjustment means is configured to decrease the pressure in the isolated volume by moving fluid from the isolated volume to an upper fluid volume above the sealing element to create an underbalance in the isolated volume, thereby negatively pressure testing the plug in use.

2. The tool according to claim 1, wherein the pressure adjustment means is configured in use to adjust the pressure in the isolated volume by moving fluid from the upper fluid volume above the sealing element to the isolated volume to create an overbalance in the isolated volume, thereby positively pressure testing the plug.

3. The tool according to claim 1, further comprising:

a fluid inlet port; and a fluid outlet port;

wherein the fluid inlet port is located between the sealing element and the plug attachment means, and is in fluid communication with the pressure adjustment means, and the fluid outlet port is located between the sealing element and the uphole end of the tool, and is in fluid communication with the pressure adjustment means.

4. The tool according to claim 1, further comprising:

a fluid inlet port; and a fluid outlet port;

wherein the fluid outlet port is located between the sealing element and the plug attachment means, and is in fluid communication with the pressure adjustment means, and the fluid inlet port is located between the sealing element and the uphole end of the tool, and is in fluid communication with the pressure adjustment means.

5. The tool according to claim 1, further comprising:

a first fluid inlet and outlet port; and a second fluid inlet and outlet port;

wherein the first fluid inlet and outlet port is located between the sealing element and the plug attachment means, and is in fluid communication with the pressure adjustment means, and the second fluid inlet and outlet port is located between the sealing element and the uphole end of the tool, and is in fluid communication with the pressure adjustment means.

6. The tool according to claim 1, further comprising:

an upper pressure sensor configured to measure a pressure in the wellbore or tubular between the sealing element and the uphole end of the tool or at the uphole end the tool in use, and/or;

an intermediate pressure sensor configured to measure a pressure in the isolated volume in use.

7. The tool according to claim 1, wherein the plug attachment means comprises a shear pin and/or electromechanical latch and/or hydraulic locking mechanism.

8. The tool according to claim 1, wherein the plug attachment means is configured in use to selectively reattach the plug at or near the downhole end of the tool and carry the plug to a desired location in the wellbore or tubular.

9. A system for delivering and pressure testing a plug in a wellbore or tubular in a single trip, the system comprising:

a tool according to claim 1; and a selectively expandable plug;

wherein the plug is configured to be releasably attached to the plug attachment means in use.

10. The system according to claim 9, wherein the plug is configured to seal against an internal surface of the wellbore or tubular in use, thereby creating a pressure tight seal.

11. The system according to claim 9, wherein the plug is an expandable or conformable packer.

12. The system according to claim 9, wherein the plug is expandable from a collapsed configuration to an expanded configuration, wherein in the collapsed configuration the plug is configured to be run into a wellbore or tubular without forming a seal with the internal surface of the wellbore or tubular, and in the expanded configuration the plug is configured to form a seal with the internal surface of the wellbore or tubular.

13. The system according to claim 9, wherein the plug is configured to be reattachable to the tool in use after the plug has been released from the tool.

14. The system according to claim 9, wherein the plug comprises a lower pressure sensor configured to measure a pressure in the wellbore or tubular below the plug in use.

15. The system according to claim 9, further comprising a tubing cutter configured to selectively cut a tubular.

16. The system according to claim 9, further comprising a tubing puncher configured to selectively form at least one aperture in a tubular.

17. A method of assembling a system for delivering a plug to a wellbore or tubular and performing a pressure test on the plug in a single trip, comprising the steps of:

a. providing a tool according to claim 1;

b. providing a selectively expandable plug configured to be releasably attached to the plug attachment means of the tool; and c. releasably attaching the plug to the plug attachment means.

18. A method of setting and pressure testing a plug in a single trip, comprising the steps of:

a. providing a system according to claim 9;

b. releasably attaching the plug to the plug attachment means;

c. running the system into a wellbore or tubular to a desired location in the wellbore or tubular;

d. moving the plug to the expanded configuration to form a pressure tight seal in the wellbore or tubular;

e. releasing the plug from the plug attachment means;

f. lifting the tool uphole in the wellbore or tubular;

g. moving the sealing element to the expanded configuration to form a pressure tight seal in the wellbore or tubular, thereby creating an isolated volume; and h. activating the pressure adjustment means to decrease the pressure in the isolated volume, thereby pressure testing the plug.

19. A method of pressure testing and setting a plug in a single trip, comprising the steps of:

i. providing a system according to claim 9;

j. releasably attaching the plug to the plug attachment means;

k. running the system into a wellbore or tubular to a desired location in the wellbore or tubular;

l. moving the plug to the expanded configuration to form a pressure tight seal in the wellbore or tubular;

m. moving the sealing element to the expanded configuration to form a pressure tight seal in the wellbore or tubular, thereby creating an isolated volume;

n. activating the pressure adjustment means to decrease the pressure in the isolated volume, thereby pressure testing the plug; and o. releasing the plug from the plug attachment means.

20. A method of pressure testing and setting a plug in a single trip, comprising the steps of:

p. providing a system according to claim 9;

q. releasably attaching the plug to the plug attachment means;

r. running the system into a wellbore or tubular to a desired location in the wellbore or tubular;

s. moving the sealing element to the expanded configuration to form a pressure tight seal in the wellbore or tubular;

t. moving the plug to the expanded configuration to form a pressure tight seal in the wellbore or tubular, thereby creating an isolated volume;

u. activating the pressure adjustment means to decrease the pressure in the isolated volume, thereby pressure testing the plug; and v. releasing the plug from the plug attachment means.

* * * * *